US005933891A

United States Patent [19]

Nachod, III

[11] Patent Number: 5,933,891

[45] Date of Patent: Aug. 10, 1999

[54] WHEELCHAIR SEATING SYSTEM INCLUDING TRAPEZOIDALLY SECTIONED FLUID BAG

[75] Inventor: Julius E. Nachod, III, Lakewood, Ohio

[73] Assignee: Invacare Corporation, Elyria, Ohio

[21] Appl. No.: 09/066,214

[22] Filed: Apr. 24, 1998

[51] Int. Cl.[6] ..... A47C 27/18; A47C 7/02

[52] U.S. Cl. ..... 5/654; 297/452.41; 297/452.24

[58] Field of Search ..... 5/654, 653, 932, 5/655.5, 712; 297/452.41, 452.22, 452.24, 452.25

[56] References Cited

U.S. PATENT DOCUMENTS

| | | | |
|---|---|---|---|
| 4,588,229 | 5/1986 | Jay | 297/459 |
| 4,726,624 | 2/1988 | Jay | 297/452 |
| 4,728,551 | 3/1988 | Jay | 428/76 |
| 4,842,330 | 6/1989 | Jay | 297/459 |
| 5,018,790 | 5/1991 | Jay | 5/654 |
| 5,093,138 | 3/1992 | Drew et al. | 428/68 |
| 5,100,712 | 3/1992 | Drew et al. | 428/68 |
| 5,189,747 | 3/1993 | Mundy et al. | 5/654 |
| 5,204,154 | 4/1993 | Drew et al. | 428/68 |
| 5,335,486 | 8/1994 | Davis | 53/452 |
| 5,362,543 | 11/1994 | Nickerson | 428/76 |
| 5,369,829 | 12/1994 | Jay | 5/654 |
| 5,390,384 | 2/1995 | Dinsmoor, III et al. | 5/654 |
| 5,395,162 | 3/1995 | Jay et al. | 5/654 |
| 5,397,517 | 3/1995 | Jay et al. | 264/45.5 |
| 5,407,481 | 4/1995 | Drew | 106/672 |
| 5,457,833 | 10/1995 | Jay | 5/654 |
| 5,490,299 | 2/1996 | Dinsmoor, III et al. | 5/654 |
| 5,507,866 | 4/1996 | Drew et al. | 106/287.1 |
| 5,592,707 | 1/1997 | Dinsmoor, III et al. | 5/654 |
| 5,671,977 | 9/1997 | Jay et al. | 5/654 |
| 5,687,436 | 11/1997 | Denton | 5/653 |
| B1 4,726,624 | 11/1993 | Jay . | |

*Primary Examiner*—Alexander Grosz
*Attorney, Agent, or Firm*—Hudak & Shunk Co., L.P.A.; Laura F. Shunk

[57] ABSTRACT

The present invention relates to a seat cushion assembly for use, in particular, in a wheelchair. The assembly includes a sculpted or molded foam base having exterior sidewalls profiled to accommodate a wheelchair frame, and a seating surface to provide some positioning support to the occupant. Further, the base includes a well area to be positioned under the ischial tuberosities of the occupant and including means for the removable attachment of a flexible envelope containing a fluid filling material. The envelope is comprised of upper and lower elastomeric sheet materials sealed about the perimeter. It is divided by internal seal sections so as to inhibit fluid migration within the envelope. These internal seals define a tapering flow orifice which provide for gradual restriction of a flow channel to permit flow so as to avoid failure inhibiting fluid migration. The envelope has a surface area which exceeds the surface area of the well and includes attachment means on the bottom side to encourage a gathering of the envelope into the well for proper cushioning effect. In addition, the assembly can include a rigidizer to enable the cushion to be used in a sling-type wheelchair seat.

27 Claims, 3 Drawing Sheets

WHEELCHAIR SEATING SYSTEM INCLUDING TRAPEZOIDALLY SECTIONED FLUID BAG

BRIEF DESCRIPTION OF THE INVENTION

The present invention relates to a seat cushion which comprises a foam base contoured for use in a wheelchair and including a topography for support positioning of the user or occupant. In addition, the cushion foam base includes a well, positioned to be located beneath the ischial tuberosities of the occupant. The well is filled with a softly gathered flexible envelope having a surface area which exceeds the surface area of the well. When laid out in a flattened position, the envelope comprises a top and a bottom rectangular elastomeric layer, heat sealed together about their periphery and internal sections. These sections include symmetrically tapering fluid orifices to form segmented fluid filled portions designed to avoid fluid migration, but also to permit some directed flow so as to inhibit rupture.

BACKGROUND OF THE INVENTION

A substantial portion of a seated person's weight is born upon the seat bones, (i.e., ischial tuberosities). For people who are restricted to wheelchairs, or otherwise to sitting positions, this area is particularly prone to the formation of pressure sores or decubitis ulcers. Patients who are victims of stroke, hip fracture, spinal cord injury and brain injury, as well as paraplegics and geriatrics are particularly susceptible to such sores. These sores are difficult to heal and require expensive prolonged recovery periods.

Attempts have been made within the prior art to provide for seating systems which cushion these areas and lessen capillary blood pressure between the seating surface and the seat bones, where pressure is otherwise likely to build up.

One such example of a prior art system is presented in U.S. Pat. No. 4,726,624 and its reissue patent. In this instant, the prior art utilizes a rigid base having a fluid filled envelope which extends over the entire base and in particular, up over side rims of a seating depression so as to cause a contact between the rigid base and the soft tissue of the user to encourage the flow of viscous fluid material underneath the seat bones of the user. Notable disadvantages of this particular system are the weight of the cushion, and the expense required by the large fluid envelope, as well as the sometimes troublesome reliance on the soft tissue used as a positioning means and means to interact indirectly with the rigid side rim of the base cushion so as to cause fluid flow down into the base of the cushion. In cases of people confined to wheelchairs, the soft tissue is not always of a shape or tone to enable reliance on this particular interface.

It is, thus, an object of the present invention to provide a seat assembly having a foam cushion which provides for primary positioning and support of the user. A further object is to provide a more circumscribed area of pressure compensation directly underneath the seat bones of the chair occupant and not extending over the entire base (i.e., less than half, preferably less than one fourth, preferably about 1/7 to 1/8 of the surface area of the base). A further object of the invention is to provide a pressure compensation envelope which is seamed so as to inhibit undesirable fluid migration, and yet to enable a limited amount of fluid transition so as to minimize the possibility of rupture at seams.

Finally, an object of the invention is to provide a simple assembly having only a few parts which can be used optionally with a rigid or sling type wheelchair seat.

DESCRIPTIONS OF THE DRAWINGS

DETAILED DESCRIPTION OF THE INVENTION

Figure 1:
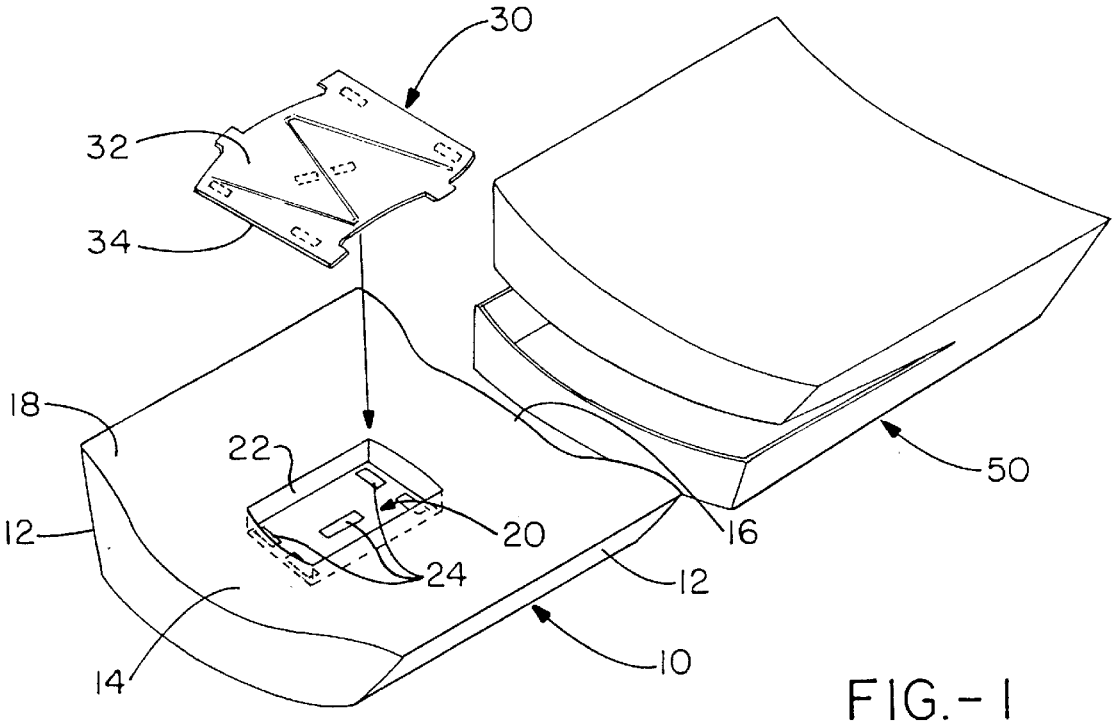
FIG. 1 is an exploded view of the seat cushion assembly of the present invention illustrating the foam base, fluid envelope, and removable cover.

The seat cushion assembly is shown generally in FIG. 1 and includes foam base member 10, fluid envelope 30 and removable cover 50. The base member 10 includes a sloped external lateral side surfaces 12, which are angled to accommodate the side rails of a wheelchair of various widths. The chair further includes a seating depression 14 which is shaped generally to accommodate and help with the positioning of the user including, for example, a front pommel 16 and a rear cantle portion, or a back edge 18 which has a rise to support the coccyx area of the user.

Figure 2:
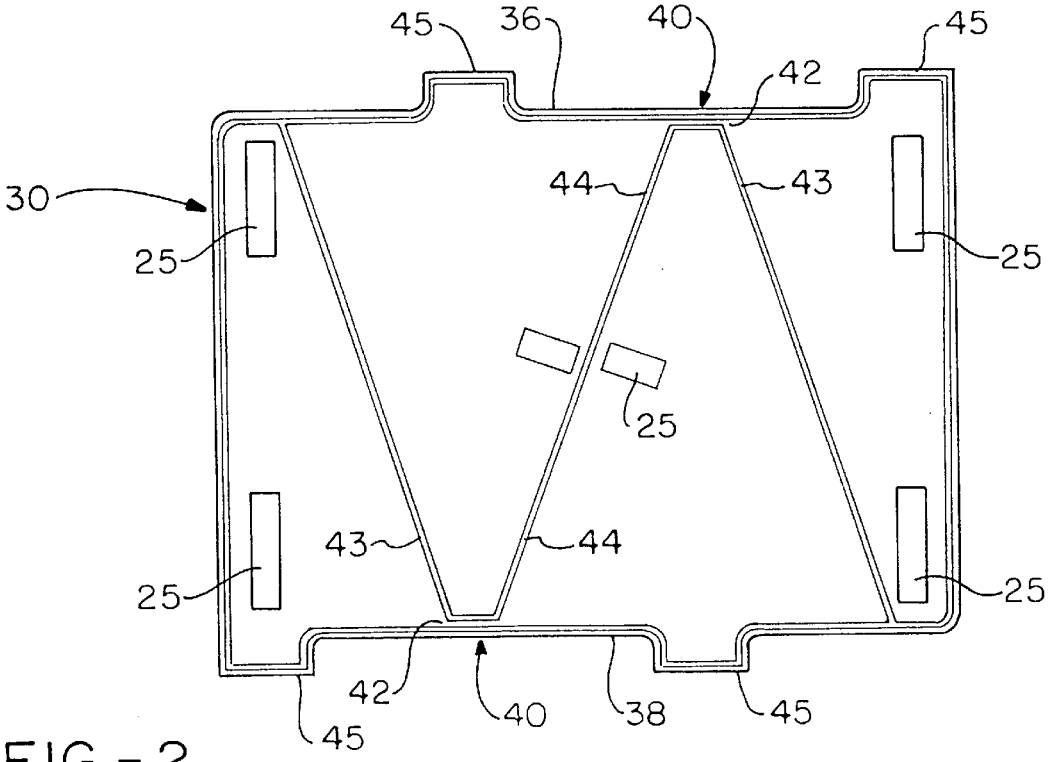
FIG. 2 is a top view of the fluid envelope illustrating the seaming scheme.

In addition, the foam cushion includes a well 20 having generally straight sides 22, which act to inhibit the fluid envelope 30 from working its way out of the well 20. The well 20 further includes one half of a series of hook & loop closure members 24 which are shown as being positioned in each corner and in the central portion of the well 20. The well 20 has a depth of about 0.75 inches to about 2.5 inches, preferably and a flat surface area which receives the bottom of the fluid filled envelope. The well is from about 3 to 9 inches long, preferably 5 to 8 inches, and from about 6 to 15 inches wide preferably from 7 to 11 inches wide. An exemplary size foam cushion has a length at the seating surface of 14 to 20 inches, preferably 10 to 18 and a width of 16 to 22 inches preferably 18 to 20 inches. It may have a depth of about 5 inches at the highest point. The fluid filled envelope 30 is generally constructed of at least two layers of elastomeric material such as polyurethane film. These layers act as the top 32 and bottom 34 of an envelope which can be seen in more detail in FIG. 2. The envelope includes interior sealing portions which extend in a generally oblique direction (i.e., diagonally), from a side seam 36 to a second side seam 38, and forming a generally parallel portion 40 which has a limited passage area 42 with respect to the exterior sealing area 38 of the envelope. In particular, the limited passage area 42 or fluid flow orifice comprises a first gradual restriction or taper 43 which narrows the flow into a channel 44. An opposing restrictive taper narrows flow in an opposite direction away from the channel 42. There is preferably a mirror symmetry on either side of the channel to avoid flow preference into one section. Preferably, the envelope includes two such flow orifices adjacent the two long sides of the envelope. These flow orifices inhibit fluid migration from one section into another (i.e., when the filling becomes unequalized). A preferable arrangement places these orifices next to the side seam of the envelope and utilizes the side seams to help define the orifice. In a preferred design, three oblique interior seals form two full trapezoidal shapes and two half trapezoidal shapes, or "Christmas trees" and "half Christmas trees" respectively. A rectangular stem portion 45 extending from the base of the trapezoid represents a fill area for each of the four trapezoidal portions. The passageway 40 has a width from about 0.060 inches to about 0.190 inches, so as to allow flow of the filling material at a pressure of about 1.0 psi to about 4.0 psi. The passage tapers are all defined by oblique internal seams at an angle of from about 65° to about 80°, preferably the passage areas 40 inhibit rupture of the envelope in the area of the angular seamed edges, or at the apex of the trapezoid. The envelope is thus divided into areas of equal volume, each consisting of ½ and 1 full tree in fluid communication with each other. It should be understood that other shapes such as curved shapes or serpentines could also be used.

In addition, the envelope includes a series of mating hook and loop means which are positioned so as to cause an optimal gathering of the envelope when it is inserted into the well 20. In particular, six rectangles of hook and loop 25 are provided, one in each corner and two in the center of the envelope.

The envelope is generally a top and bottom rectangular section of elastomeric material, each being a single layer or double layer of 4 mil to 8 mil, translucent aromatic polyether polyurethane film. A number of flow materials can be used, such as for example, air or viscous fluid such as for example, microspheres in a petroleum derivative at a weight ratio of microspheres to petroleum derivative of about to 1:10 to 1:5. An optimal filling is to a pressure of about 1.0 to 4.0 psi. Since the envelope is essentially divided into two areas, equalization can occur after assembly. Generally speaking, the top and bottom layers are cut from the appropriate material and joined together such as by heat sealing or RF welding. A fill process takes place at the stems 45, and the rectangular stem portion are subsequently sealed and cut to result in manufacture of the envelope.

A suitable material for the base cushion is molded polyurethane foam including a water impermeable covering such as spray vinyl or neoprene so as to protect the foam from soiling. Particularly suitable foam characteristics are a foam density of 3 to 4 lbs./cu. ft., more preferably 3.2 to 3.6 lbs./cu. ft. and a support factor of 2 to 3. The cushion can be molded or cut from foam slab stock. In addition, the seating assembly includes a removable cover shown as including a stretchable top cover portion which extends over the side of the cushion. A seam preferably runs along the bottom outside edge of the cushion to provide an aesthetic appearance. A suitable material for the top portion of the cushion is a stretch fabric such as spandex and/or Darlex sold by DuPont Industries. A nylon backing with or without a polyurethane intermediate layer is optional. A suitable bottom portion includes the same materials or non-stretch fabrics with a non-sliding surface such as dotted PVC material.

Figure 3:
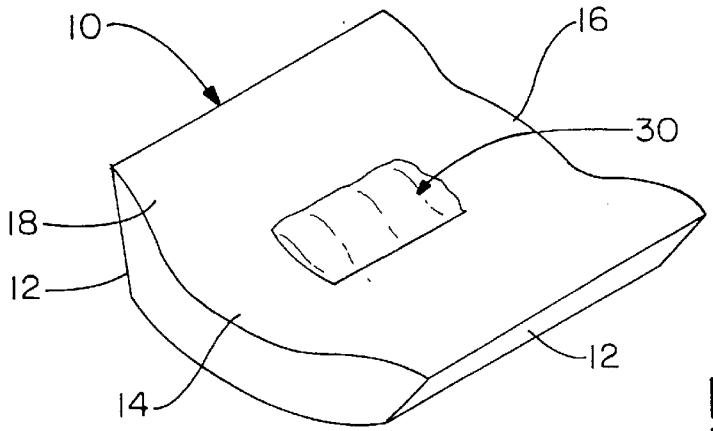
FIG. 3 is a perspective view of the foam base with the fluid envelope in position within the pressure compensation well.
Figure 4:
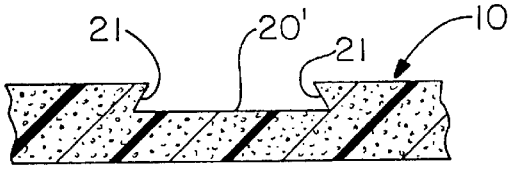
FIG. 4 is an alternative embodiment of the invention, illustrating in detail, the seat cushion showing the well in accordance with a second embodiment of the invention.
Figure 5:
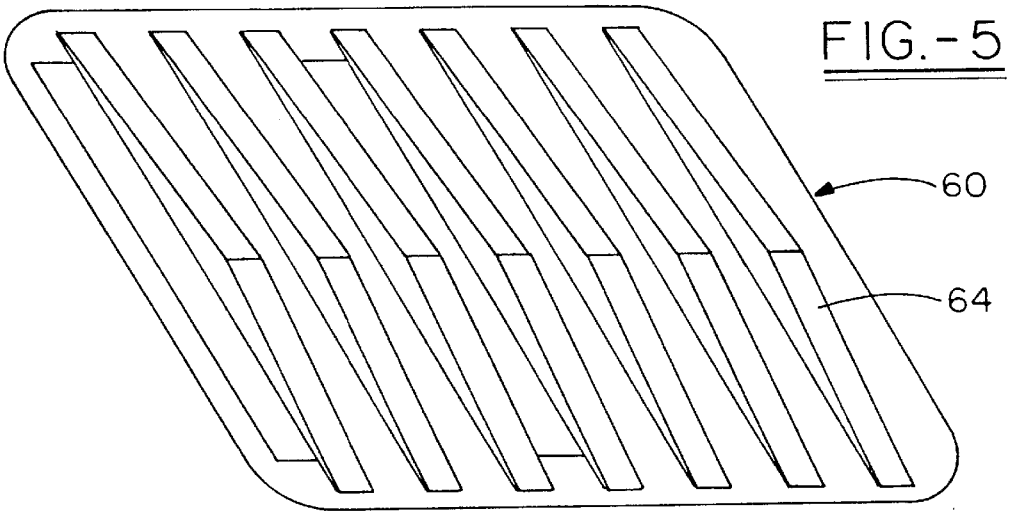
FIG. 5 is a three fourths perspective view of a rigidizer to enable use of the seating assembly with a sling seat wheelchair.
Figure 8:
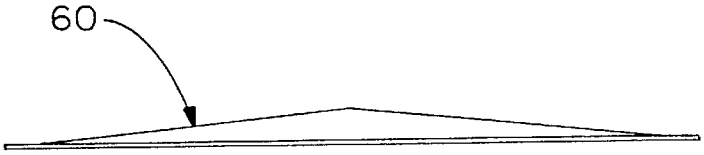
FIG. 8 is an end view of the rigidizer of FIG. 6.
Figure 6:
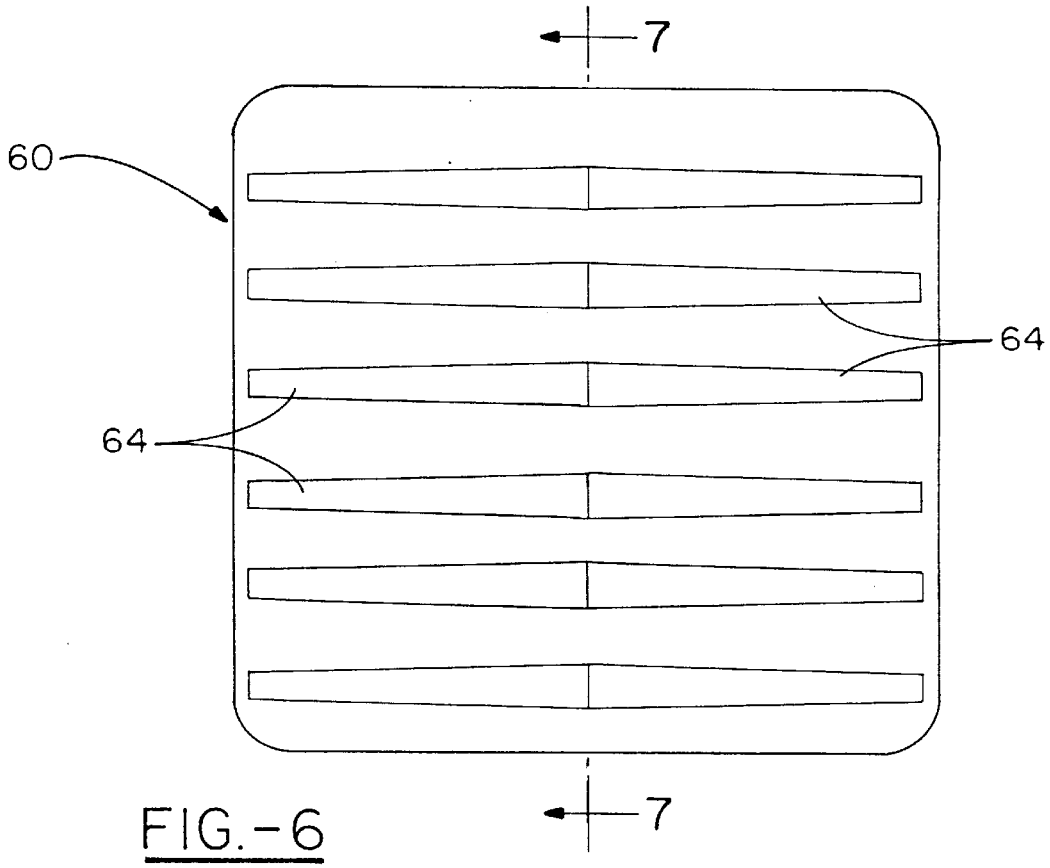
FIG. 6 is a top view of the rigidizer of FIG. 5.
Figure 7:
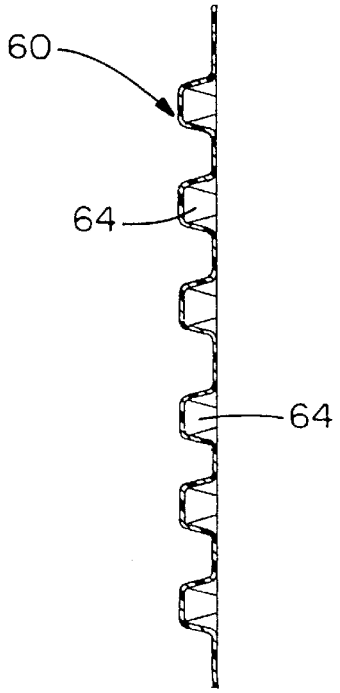
FIG. 7 is a section taken at line A—A of FIG. 6.

FIG. 3 illustrates the envelope gathered into the well 20 and attached by the hook and loop means. In FIG. 4, the foam base 10 is shown in cross section illustrating a second embodiment of the well having two or more sides 21 (preferably opposing) which are undercut or sloped in reverse. In particular, the two sides parallel to the external lateral sides 12 have this reverse slope in this embodiment.

In addition, a rigidizer 60 can be provided for use with a sling wheelchair encompassing a ribbed molded plastic board having ribs 64 which cooperate to define two angled bottom surfaces. The upper surfaces of the ribs 64 act to form a base to support the bottom of the base cushion 10 and to provide lateral stiffness to the cushion. The angled bottom surfaces take up the slack of a sling wheelchair so as to enable the use of the cushion in a sling wheelchair, as well as in a rigid frame.

While in accordance with the Patent Statutes, the best mode and preferred embodiment have been set forth, the scope of the invention is not limited thereto, but rather by the scope of the attached claims.

What is claimed is:

1. A seat assembly comprising a base having a top surface shape having a surface area and defining a seating depression with a well having a surface area less than the surface area of the base and positioned to be under the ischial tuberosities of an occupant of said seat assembly, said seating well including a pressure compensation pad comprising an elastomeric envelope having a surface area which is greater than the surface area of said well, and having at least two volumes each including fluid means which flow in response to pressure, at least one of said volumes being divided by a flow orifice into first and second sections, said flow orifice having a restricted passage defining a longitudinal axis, said restrictive passage being connected along said longitudinal axis to a first taper open to said first section which narrows in a first direction to said restricted passage and a second taper open to said second section which broadens away from said restricted passage in said first direction along said longitudinal axis, whereby fluid migration between said first and said second section is inhibited and seam failure and rupture of said envelope in the vicinity of said fluid orifice in response to seating pressure is minimized.

2. A seat cushion assembly as set forth in claim 1, wherein said envelope has a longitudinal axis and the longitudinal axis of said fluid orifice is substantially aligned with the direction of said longitudinal axis of said envelope.

3. A seating system as set forth in claim 2 including a rigidizer, said rigidizer having a top surface and a bottom surface, said bottom surface having two lateral faces which meet at an angle and said top surface being substantially plannar.

4. A seating system as set forth in claim 3 wherein said rigidizer includes projecting rib members which form said lateral faces.

5. A seating assembly as set forth in claim 1 wherein the base of said seat system is comprised of a foam.

6. A seating assembly as set forth in claim 5 wherein the top surface shape of said base further includes a pommel.

7. A cushion assembly as set forth in claim 6 wherein said envelope has a top membrane layer and a second membrane layer with an opening there between to form said volumes, and a seam connects said top layer and said second layer to define said sections and said fluid orifice.

8. A seat system as set forth in claim 7 wherein said envelope is substantially rectangular and said first and second volumes are substantially equal.

9. A seating system as set forth in claim 8 wherein said envelope includes two lateral and two longitudinal peripheral seams and said fluid orifice is adjacent one of said two longitudinal seams.

10. A seating system as set forth in claim 9 wherein said fluid envelope includes from two to four fluid orifices.

11. A seating system as set forth in claim 10 wherein said fluid orifices are each adjacent a longitudinal seam.

12. A seating system as set forth in claim 1, wherein said base cushion comprises foam and further includes a water impermeable outer surface.

13. A seating system as set forth in claim 12, including a cover member.

14. A seating system as set forth in claim 1, wherein said volumes each comprise two trapezoidal shaped sections connected by a flow orifice.

15. A seating system as set forth in claim 14, wherein each of said trapezoidal shaped sections includes a sealed fill port.

16. A seating system as set forth in claim 1 wherein said well has side walls which are vertical or are undercut.

17. A seating system as set forth in claim 1 wherein said well has a surface area of from about 20 to about 100 $inch^2$.

18. A seat assembly comprising a foam base having a top surface shape with a surface area and defining a seating depression with a well having a surface area less than half of the surface area of the base, said well being positioned to be under the ischial tuberosities of an occupant of said seat assembly, said seating well including a pressure compensation pad comprising a rectangular elastomeric envelope sealed about its periphery and having a surface area which is greater than the surface area of said well, and having internal seals which form at least two volumes each including fluid means which flow in response to pressure, each of said volumes being divided by a flow orifice into first and second unequal sections, each of said flow orifices having a restricted passage defining a longitudinal axis, said restrictive passage being connected along said longitudinal axis to a first taper open to said first section which narrows to said restricted passage in a first direction and a second taper open to said second section which broadens away from said restricted passage in said first direction along said longitudinal axis, whereby fluid migration between said first and said second section is inhibited and seam failure and rupture of said envelope in the vicinity of said fluid orifice in response to seating pressure is minimized.

19. A seat cushion assembly as set forth in claim 18, wherein said envelope has a longitudinal axis and the longitudinal axis of said fluid orifice is substantially aligned with the direction of said longitudinal axis of said envelope.

20. A seat cushion assembly as set forth in claim 19 wherein said fluid orifices are each adjacent a longitudinal seam.

21. A pressure compensation pad comprising an elastomeric envelope, and having at least two volumes each including fluid means which flow in response to pressure, at least one of said volumes being divided by a flow orifice into first and second sections, said flow orifice having a restricted passage defining a longitudinal axis, said restrictive passage being connected along said longitudinal axis to a first taper open to said first section which narrows to said restricted passage in a first direction and a second taper open to said second section which broadens away from said restricted passage in said first direction along said longitudinal axis, whereby fluid migration between said first and said second section is inhibited and seam failure and rupture of said envelope in the vicinity of said fluid orifice in response to seating pressure is minimized.

22. A pressure compensation pad as set forth in claim 21, wherein said envelope has a longitudinal axis and the longitudinal axis of said fluid orifice is substantially aligned with the direction of said longitudinal axis of said envelope.

23. A pressure compensation pad as set forth in claim 22 wherein said envelope has a top membrane layer with a second membrane layer with an opening there between to form said volumes, and a seam connects said top layer and said second layer to define said sections and fluid orifice.

24. A pressure compensation pad as set forth in claim 23 wherein said envelope is substantially rectangular and said first and second volumes are substantially equal.

25. A pressure compensating pad as set forth in claim 24 wherein said envelope includes two lateral and two longitudinal seams and said fluid orifice is adjacent one of said two longitudinal seams.

26. A pressure compensating pad as set forth in claim 25 wherein said fluid envelope includes from two to four fluid orifices.

27. A pressure compensating pad as set forth in claim 26 wherein said fluid orifices are each adjacent a longitudinal seam.

* * * * *